US007188590B2

(12) United States Patent
Schiestl et al.

(10) Patent No.: US 7,188,590 B2
(45) Date of Patent: Mar. 13, 2007

(54) COMBUSTION-ENGINED SETTING TOOL

(75) Inventors: Ulrich Schiestl, Feldkirch (AT); Ulrich Rosenbaum, Wangs (CH); Hans Gschwend, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/246,400

(22) Filed: Oct. 7, 2005

(65) Prior Publication Data

US 2006/0075978 A1 Apr. 13, 2006

(30) Foreign Application Priority Data

Oct. 11, 2004 (DE) ..... 10 2004 049 474

(51) Int. Cl.
*F02B 71/00* (2006.01)

(52) U.S. Cl. ..... 123/46 SC; 227/10

(58) Field of Classification Search ..... 123/46 R, 123/46 SC; 227/10
See application file for complete search history.

*Primary Examiner*—Noah P. Kamen
(74) *Attorney, Agent, or Firm*—Abelman, Frayne & Schwab

(57) ABSTRACT

A combustion-engined setting tool for driving fastening elements such as nails, bolts, pins and the like in a constructional component, includes a combustion chamber (14) having an axially displaceable wall (14) displaceable over at least one guide (29) arranged in the combustion chamber (14) by a press-on element (30), a guide cylinder (12) adjoining the combustion chamber (14) and in which a setting piston (11) is displaceable for driving the fastening elements in the constructional component, and a lever drive (20) operatively connecting the press-on element (30) with the displaceable wall (17) for displacing the same in accordance with a transformation ratio between a press-on stroke and a displacement stroke of the displaceable wall (14).

7 Claims, 2 Drawing Sheets

COMBUSTION-ENGINED SETTING TOOL

BACKGROUND OF THE INVENTION

1. Field of the Invention

The present invention relates to a combustion-engined setting tool for driving fastening elements such as nails, bolts, pins and the like in a constructional component and including a combustion chamber for combusting an oxidant-fuel gas mixture and having an axially displaceable wall displaceable over at least one guide arranged in the combustion chamber by a press-on element, a guide cylinder adjoining the combustion chamber, and in which a setting piston is displaceably arranged for driving the fastening elements in the constructional component, and a gear drive operatively connecting the press-on element with the displaceable wall of the combustion chamber for displacing the displaceable wall in accordance with a transformation ratio between a press-on stroke and a displacement stroke of the displaceable wall.

2. Description of the Prior Art

Setting tools of the type described above are driven with gaseous or liquid fuels that are evaporated before combustion. The setting energy for driving in a fastening element is produced by combustion of a fuel-gas-oxidant mixture which fills the combustion chamber, and is transmitted to the fastening element by a setting piston. As an oxidant, e.g., oxygen from the surrounding air is used. Therefore, before each setting process. Fresh air should be brought into the combustion chamber, and after each setting process, the flue gas, which was produced by combustion of the oxidant-fuel gas mixture, should be removed from the combustion chamber.

In order to be able to effect a setting process, the setting tool should be pressed against a constructional component in order to prevent actuation of the setting tool in the absence of the contact of the setting tool with the constructional component. For ergonomical reasons, the press-on stroke should be as short as possible.

German Publication DE 40 32 203 A1 discloses a setting tool having a combustion chamber and a setting piston displaceable in a guide cylinder and driven by pressure generated as a result of combustion of an air-fuel mixture in the combustion chamber. The combustion chamber is located in a first housing part. The housing also has a second housing part displaceable relative to the first housing part. The guide cylinder is also displaceable relative to the combustion chamber. The guide cylinder is displaced by an intermediate rack and pinion gear as a result of the displacement of the second housing part relative to the first housing part. The displacement of the second housing part relative to the first housing part resulting from the setting tool being pressed against a constructional component, leads to displacement of the guide cylinder out of the combustion chamber, whereby the combustion chamber volume is increased.

In DE 40 32 203 A1, the combustion chamber is divided in several sub-chambers. The sub-chambers are separated from each other by at least one displaceable intermediate or separation plate displaceable together with the guide cylinder. For removal of the flue gas from the combustion space, the guide cylinder is displaced, together with the combustion chamber wall arranged thereon, back into the combustion chamber. This reduces the space of both sub-chambers to a minimum. The intermediate wall is displaced with the guide cylinder. As a result of the volume reduction of the sub-chambers, the flue gas is forced out of the combustion chamber. When the sub-chambers expand upon the setting tool being pressed against a constructional component again, they are again filled with fresh air.

The drawback of the setting tool described above consists in the complicated drive mechanics responsible for expansion of the combustion space of the combustion chamber.

In a setting tool Hilti GX 100 of the assignee herein, a bolt guide adjoins, in the drive-in direction, a piston guide in which a setting piston is displaceably arranged. A combustion chamber adjoins the piston guide at the end of the piston guide opposite the bolt guide. The combustion chamber has a rear wall displaceable along the axis of the combustion chamber. Upon the setting tool being pressed against a constructional component, the rear wall of the combustion chamber is displaced away from the piston guide up to an end of the combustion chamber remote from the piston guide, tensioning the return spring. The combustion chamber is in its expanded condition. Simultaneously with the expansion of the combustion chamber, it is filled with fresh air. The necessary press-on path is the same as the displacement path of the rear wall that corresponds to the axial length of the combustion chamber. After the completion of the setting process and lifting of the setting tool off the constructional component, the rear wall is displaced to its initial position by the biasing force of the return spring. The flue gases are forced out as the combustion chamber collapses. The advantage of this setting tool consists in that flushing is effected mechanically, and no batteries or accumulators are needed.

However, the above-described setting tool has a relatively long press-on path and a relatively large diameter of the combustion chamber.

European Patent EP 0 711 634 B1 discloses a combustion-engined setting tool having a combustion chamber in which an air-fuel gas mixture is combusted. Inside of the combustion chamber, there is provided ventilator means for generating turbulence. The ventilator means is driven by an electric motor which is supplied with an electrical energy from a battery. Because of the use of the ventilator means for flushing of the combustion chamber, the press-on path can be relatively short.

The drawbacks of the setting tool of EP 0 711 634 B1 consist in its large weight because of necessity in batteries or accumulators, and also in the need to replace them when their energy expires.

Accordingly, an object of the present invention to provide a setting tool of the type described above in which the drawbacks of the known setting tools are eliminated.

SUMMARY OF THE INVENTION

These and other objects of the present invention, which will become apparent hereinafter, are achieved by providing in the setting tool of the type described above, a lever drive that operatively connects the press-on element with the displaceable wall of the combustion chamber for displacing the displaceable wall in accordance with a transformation ratio between a press-on stroke and a displacement stroke of the displaceable wall.

The displacement of the displaceable wall such as, e.g., the rear wall of the combustion chamber by a lever drive that transforms the press-on movement into a displacement movement with a predetermined ratio, permits to provide an ergonomic press-on stroke with a simultaneous reduction of the diameter of the combustion chamber, while also reducing the number of parts and assembly costs.

In addition, a lever drive is not subjected to any noticeable wear and requires little maintenance.

According to a technically simple embodiment of the present invention, the lever drive has at least two lever arms, and at least one radially and axially displaceable pivot support, a stationary pivot support secured on a member connected with the guide cylinder, and an axially displaceably but radially stationary pivot support connected with the displaceable wall of the combustion chamber, with the at least two lever arms being supported at their respective ends by respective pivot supports.

Advantageously, the member, which is connected with the guide cylinder, is a guide along which the displaceable wall is displaced.

Advantageously, there are provided four lever arms which form a parallelogram. This insures a uniform application of the force to the displaceable wall or the rear wall of the combustion chamber, whereby tilting of the movable components is prevented.

Advantageously, the lever drive includes a spring for returning the lever drive and the displaceable wall into their initial positions and which is tensioned in response to the press-on movement.

Advantageously, the spring is formed as a torsion spring, which together with the kinematics of the lever drive, permits to achieve a substantially linear spring characteristic. This provides for a substantially same press-on force over the entire press-on path.

Advantageously, the lever drive is directly operationally connected with the displaceable wall, which insures a loss-free transformation of the press-on displacement in the displacement of the displaceable wall.

The novel features of the present invention, which are considered as characteristic for the invention, are set forth in the appended claims. The invention itself, however, both as to its construction and its mode of operation, together with additional advantages and objects thereof, will be best understood from the following detailed description of the preferred embodiment, when read with reference to the accompanying drawings.

DETAILED DESCRIPTION OF THE PREFERRED EMBODIMENT

Figure 1:
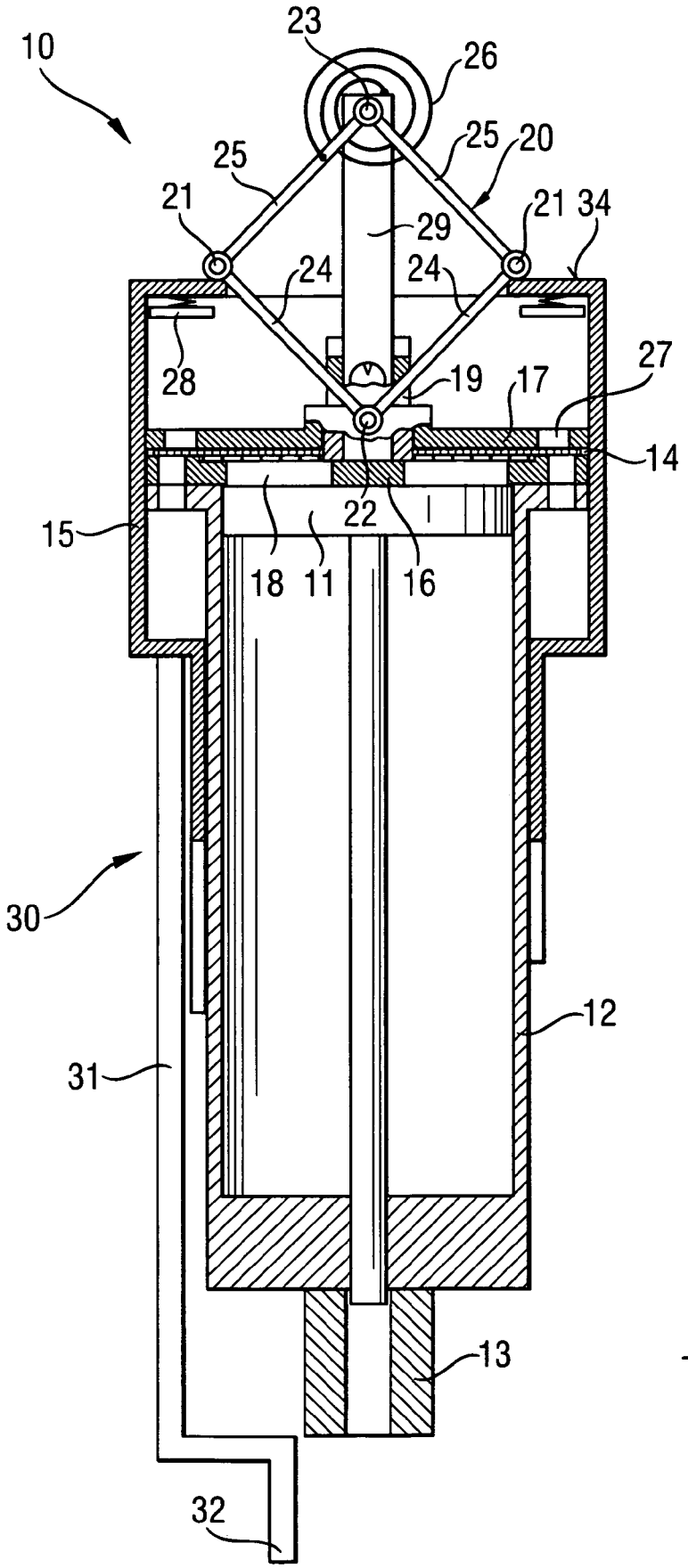
FIG. 1 a longitudinal cross-sectional view of a setting tool according to the present invention in an initial position.
Figure 2:
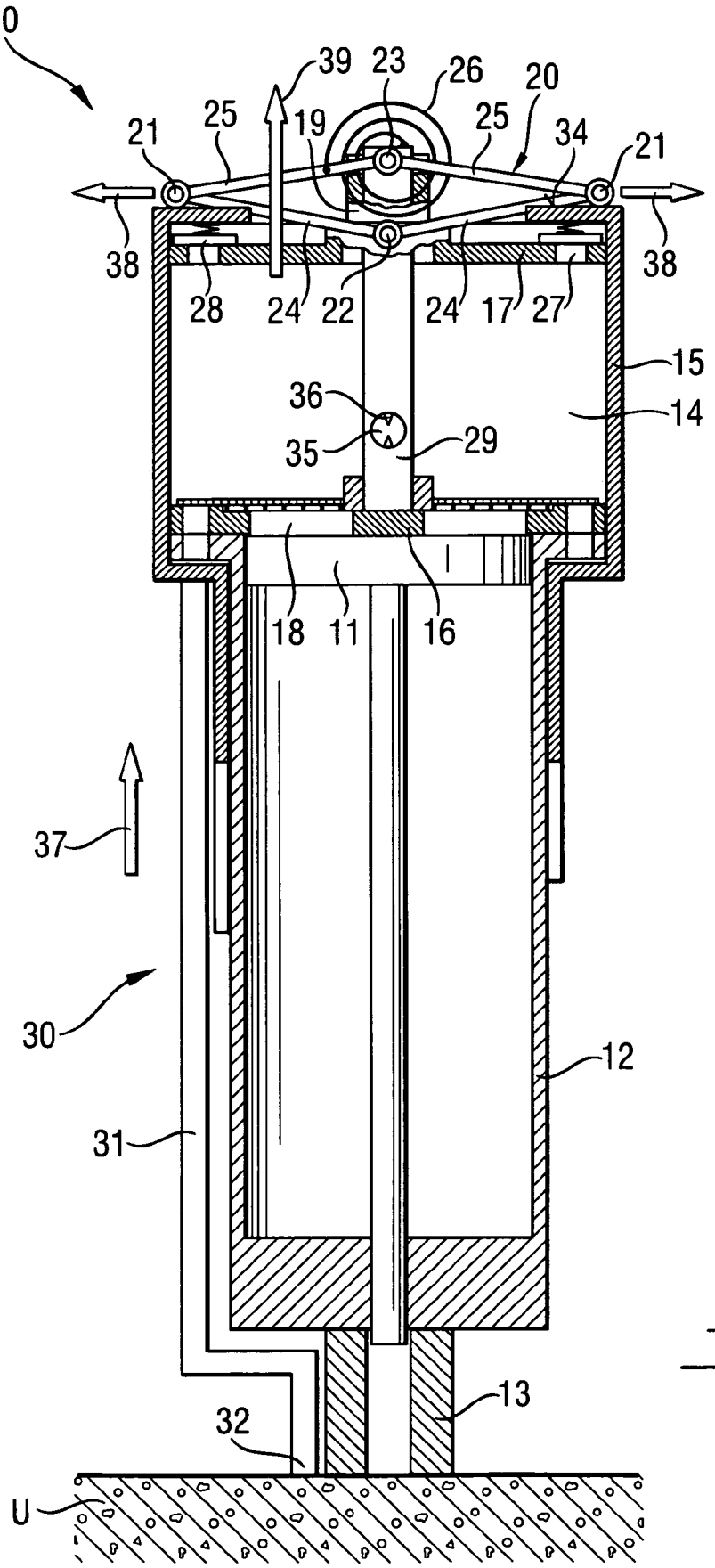
FIG. 2 a longitudinal, cross-sectional view of the setting tool shown in FIG. 1 in a position in which the tool is pressed against a constructional component.

A combustion-engined setting tool 10 according to the present invention, which is shown in FIGS. 1–2 is driven with fuel gas that is stored in form of a liquefied gas in a fuel reservoir, not shown. Instead of the fuel gas, an evaporated liquid fuel such as, e.g., alcohol or gasoline can be used. The setting tool 10 includes a setting mechanism with which a fastening element, not shown, can be driven in a constructional component U when the setting tool is pressed thereagainst and is actuated. The setting mechanism includes, among others, a combustion chamber 14, a piston guide 12 in which a setting piston 11 is arranged for an axial displacement therein, and a bolt guide 13 that adjoins the piston guide 12 at the side of the piston guide 12 remote from the combustion chamber 14. The bolt guide 13 serves for guiding of a fastening element, e.g., a bolt or a nail. The fastening elements can be stored, e.g., in a magazine secured to the setting tool 10.

In the initial position of the setting tool 10, which is shown in FIG. 1, the combustion chamber 14 is in its collapsed condition. The combustion chamber sleeve 15 is formed substantially as a cylindrical sleeve and is displaceably arranged with respect to the piston guide. An end wall 16 of the combustion chamber 14, which is formed as a plate provided with openings 18, is fixedly held on an end of the piston guide 12 adjacent to the combustion chamber 14. A displaceable wall 17 or the combustion chamber rear wall is displaceable, together with its support sleeve 19, along a guide 29 that is formed as a guide bar. The guide 29 is secured centrally to the end wall 16 of the combustion chamber 14.

The setting tool 10 further includes a press-on-element 30 that includes a press-on bar 31. In the initial position of the setting tool 10, which is shown in FIG. 1, a free end 32 of the press-on bar 31 projects beyond the bolt guide 13. The press-on bar 31 is operatively connected with the combustion chamber sleeve 15 for transmitting the press-on movement of the press-on bar 31 to the sleeve 15.

Between the press-on element 30 and the displaceable combustion chamber wall 17, there is arranged a lever drive 20 that transmits the press-on movement of the press-on bar 31 and the combustion chamber sleeve 15 to the displaceable wall 17, displacing the displaceable wall 17 in accordance with a predetermined transformation ratio between the press-on displacement of the press-on bar 31 and the sleeve 15 and the displacement of the displaceable wall 17. The lever drive 20 includes a first pivot support 22 which is secured to the support sleeve 19 and which supports two second lever arms 24 the opposite ends of which are supported on respective second pivot supports 21. The first pivot support 22 is displaceable in the axial direction, together with the support sleeve 19, but remains substantially stationary in the radial direction. The second pivot supports 21 are displaceable in both the axial direction and the radial direction, with respect to the axis of the combustion chamber jacket. The third pivot support 23 is fixedly secured on the free end of the guide 29. Lever arms 25, which the third pivot support 23 supports, connect the third pivot support 23 with respective second pivot supports 21. The lever arms 24, 25 are pivotally supported on all of the pivot supports 21, 22, 23 and form a parallelogram. The second pivot supports 21 are displaceably supported on support surfaces 34 of the press-on element 30 which are provided, in the embodiment of the setting tool 10 shown in the drawings, on the combustion chamber sleeve 15. Between at least one of the lever arms 25 and the guide 29, there is arranged return means in form of a spring 26. In FIG. 1, the spring 26 is shown in at least partially released condition. The spring 26 is formed as a torsion spring with a flat spring characteristic.

When the setting tool 10 is pressed, as shown in FIG. 2, against a constructional component U, the press-on bar 31, a free end 32 of which contacts the constructional component U first, is displaced in the direction of arrow 37. The press-on bar 31 applies pressure to the combustion chamber sleeve 15, displacing it relative to the piston guide 12 likewise in the direction of the arrow 37. As a result of the pressure applied by the support surfaces 34, which are provided on the sleeve 15, to the second pivot supports 21 of the lever drive 20, the pivot supports 21 are likewise displaced in the direction of the arrow 37. Simultaneously, the pivot supports 21 are displaced radially in the direction of arrow 38 away from each other as a result of the third pivot support 23, which is connected with the pivot supports 21 by lever arms 25, being fixedly secured on the free end of the guide 29. As a result of the radial displacement of the second pivot supports 21 away from each other, the first pivot support 22, which is secured on the support sleeve 19, is displaced in the direction of arrow 39 with a ratio of 2:1 with respect to the displacement of the sleeve 15. Dependent on the layout of the lever drive 20, other transformation ratios can be obtained. The displaceable wall 17, which is displaced together with the support sleeve 19 and the first pivot support 21, will be, thus, displaced with a stroke corresponding to a double of the press-on stroke. With the displacement of the lever arms 25 relative to the third pivot support 23, the spring 26, which forms the return means, would be tensioned.

When the setting tool 10 is lifted off the constructional component, the restoring force of the spring 26 provides for collapsing of the combustion chamber 14, causing displacement of the displaceable wall 17 and the combustion chamber sleeve 15 in their initial, shown in FIG. 1, positions. It should be pointed out that together with the spring 26, other return elements, which can be arranged on the lever drive 20 or, e.g., on the press-on element 30, can be used. The spring 26 can also be arranged on another pivot-support-lever arm pair.

In the operational position of the setting tool 10, which is shown in FIG. 2 and in which the combustion chamber 14 is completely expanded, the displaceable wall 17 is located in its second position, at the end of the combustion chamber sleeve 15. In this position, the displaceable wall 17 is locked as soon as the actuation switch is actuated. The openings 27 on the displaceable wall 17 are closed with valve means 28, so that the combustion chamber 14 is sealed and is ready for a setting process. A fuel gas-air mixture fills the combustion chamber 14 and is ignited by an ignition unit 36, e.g., a spark plug. In the embodiment shown in the drawings, the ignition unit 36 is arranged in an opening 35 formed in the guide 19. The ignition unit 36 is actuated when an actuation switch or trigger, not shown, is actuated.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A combustion-engined setting tool for driving fastening elements in a constructional component, comprising:

a combustion chamber (14) for combusting an oxidant-fuel gas mixture and having an axially displaceable wall (17) displaceable over at least one guide (29) arranged in the combustion chamber (14);

a guide cylinder (12) adjoining the combustion chamber (14);

a setting piston (11) displaceable in the guide cylinder (12) for driving the fastening elements in the constructional component;

a press-on element (30) for displacing the displaceable wall (17) of the combustion chamber; and a lever drive (20) operatively connecting the press-on device (30) with the displaceable wall (17) of the combustion chamber (14) for displacing the displaceable wall (17) in accordance with a transformation ratio between a press-on stroke and a displacement stroke of the displaceable wall (17).

2. A combustion-engined setting tool according to claim 1, wherein the lever drive (20) comprises at least two lever arms (24, 25); and at least one radially and axially displaceable pivot support (21), a stationary pivot support (23) secured on a member connected with the guide cylinder (12), and an axially displaceable and radially stationary pivot support (22) connected with the displaceable wall (17) of the combustion chamber (14), the at least two lever arms (24, 25) being supported at respective ends thereof by respective pivot supports (21, 22, 23).

3. A combustion-engined setting tool according to claim 2, wherein the stationary pivot support (23) is secured on the guide (29) which is fixedly connected with the guide cylinder (12).

4. A combustion-engined setting tool according to claim 2, comprising at least four lever arms (24, 25) forming a parallelogram.

5. A combustion-engined setting tool according to claim 1, wherein the lever drive (20) includes at least one spring member (26) for returning the lever drive (20) and the displaceable wall (17) in initial positions thereof.

6. A combustion-engined setting tool according to claim 5, wherein the spring member (26) is formed as a torsion spring.

7. A combustion-engined setting tool according to claim 1, wherein the lever drive (20) is substantially directly connected with the displaceable wall (17).

* * * * *